US005096666A

United States Patent [19]

Farnsworth et al.

[11] Patent Number: 5,096,666

[45] Date of Patent: Mar. 17, 1992

[54] RARE EARTH AND ALUMINIUM CONTAINING GALVANIZING BATH AND METHOD

[76] Inventors: Verdun H. Farnsworth, 106A Godden Place, Mission Bay; Nigel T. Evans, 12 Polandson Place, Auckland, both of New Zealand

[21] Appl. No.: 402,032

[22] Filed: Sep. 5, 1989

[30] Foreign Application Priority Data

Sep. 2, 1988 [NZ] New Zealand ..... 226024

[51] Int. Cl.[5] ..... C22C 18/04

[52] U.S. Cl. ..... 420/514; 420/513; 420/523

[58] Field of Search ..... 420/514, 513, 523

[56] References Cited

U.S. PATENT DOCUMENTS

| | | | |
|---|---|---|---|
| 3,962,501 | 6/1976 | Ohbu et al. | 427/433 |
| 4,439,397 | 3/1984 | Dreulle | 420/519 |
| 4,448,748 | 5/1984 | Radtke et al. | 420/514 |
| 4,789,522 | 12/1988 | Smith et al. | 420/514 |
| 4,802,932 | 2/1989 | Billiet | 148/23 |
| 4,812,371 | 3/1989 | Shindou | 428/659 |
| 4,952,368 | 8/1970 | Skenazi et al. | 420/513 |

FOREIGN PATENT DOCUMENTS

| | | |
|---|---|---|
| 0037143B1 | 10/1981 | European Pat. Off. . |
| 0042636A2 | 12/1981 | European Pat. Off. . |
| 61-204361 | 9/1986 | Japan . |
| 63-262451A | 10/1988 | Japan . |
| 83/008855 | 3/1983 | PCT Int'l Appl. . |

*Primary Examiner*—William R. Dixon, Jr.
*Assistant Examiner*—Alan Wright
*Attorney, Agent, or Firm*—Fleit, Jacobson, Cohn, Price, Holman & Stern

[57] ABSTRACT

A galvanizing bath having a composition of about 5 ppm to about 100 ppm by weight aluminum, and rare earth elements by weight rated at zero and not exceeding about 5 ppm. In the method a galvanizing bath composition is maintained according to the foregoing in which aluminum and rare earth materials are added to the bath at a ratio greater than the ratio of the selected concentrations of rare earth materials and aluminum in the galvanizing bath.

20 Claims, No Drawings

RARE EARTH AND ALUMINIUM CONTAINING GALVANIZING BATH AND METHOD

This invention relates to a galvanizing bath composition and/or methods of maintaining a galvanizing bath composition.

The alloying of Al in a zinc galvanizing bath in the concentration 5 ppm by weight to 100 ppm by weight of material in the bath is a practice widely used in conjunction with an ammonium chloride and/or zinc chloride containing flux. The benefits of adding Al as an alloying element can be summarized as providing an improvement in the appearance of the galvanized coating. More specifically, the benefits are that the rate of oxidation at the surface of the galvanizing bath is decreased, the drainage of zinc from the galvanized articles as they are withdrawn from the bath is improved and a shining galvanized coating is produced.

The addition of aluminum to a galvanizing bath is straightforward because Al and zinc have a low melting point and aluminum does not form intermetallic compounds with zinc. It is normally carried out in one of the following ways: (i) By preparation and then addition of a zinc-based master alloy containing an Al concentration greater than the desired bath concentration. A composition of the master alloy close to the eutectic composition favours fast dissolution in the galvanizing bath. (ii) By prealloying the Al in the make-up zinc blocks such that replenishment of the aluminium in the bath occurs along with the zinc. (iii) By immersion of Al metal in the bath so that the Al in the bath is replenished more or less at the same rate as it is depleted.

To fully realize the benefits stated above, the Al concentration of Al in the galvanizing bath should be maintained close to an upper limit which if exceeded produces undesirable chemical reactions with the chloride based flux and consequent defects in the coating known as black spots. For dry galvanizing (characterised by the absence of a molten flux cover on the bath surface) this upper limit of aluminum is in the range of 70 to 100 ppm by weight. For a wet galvanizing practice (characterized by the presence of a molten flux cover on the bath surface) this upper limit of aluminium is in the range of 15 to 25 ppm by weight. In wet galvanizing there is a corresponding diminution of the benefits.

A further disadvantage is the well-known tendency of Al in a galvanizing bath to enhance the rate of superficial corrosion of the coating. This can manifest itself as early dulling of the coating under normal weathering through to rapid white rusting when stored under humid conditions.

Simple treatments devised to retard this corrosion such as dipping the freshly galvanized article in a chromic acid solution are decreased in effectiveness because the Al tends to concentrate in the surface layer of the coating as Al oxide thus preventing the chromic acid fully reacting with the zinc.

BRIEF SUMMARY OF THE INVENTION

It is therefore an object of the present invention to provide a galvanizing bath composition and/or methods of maintaining a galvanizing bath composition which will obviate or minimize the foregoing disadvantages in a simple yet effective manner.

Accordingly, in one aspect the invention consists in a zinc allow for hot dip galvanizing bath composition comprising about 5 ppm to about 100 ppm by weight of Al, and rare earth elements by weight greater than 0 and not exceeding about 5 ppm.

In a further aspect the invention consists in a method of maintaining a galvanizing bath composition according to the preceding paragraph said method comprising the steps of adding Al and rare earth materials to said bath, the ratio of added rare earth materials to added being a ratio greater than the ratio of selected concentrations of rare earth materials and Al in said galvanizing bath.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

DETAILED DESCRIPTION

The invention consists in the foregoing and also envisages constructions of which the following gives examples only.

One preferred form of the invention will now be described.

In the preferred form of the invention a galvanizing bath is provided which has Al alloyed into the zinc in a range of 5 ppm to 100 ppm and preferably 10 ppm to 35 ppm for a dry bath and 5 ppm to 15 ppm for a wet bath. The bath also contains rare earth elements such as provided by mischmetal in amounts greater than 0 and less than 5 ppm. Preferably the rare earths are present in a range 0.2 to 3 ppm.

Other materials may be present in the galvanizing bath, such as lead up to 1.5% by weight, nickel up to 2000 ppm and minor non-specific amounts of Sn, Cd, Cu, Sb, Mg and Si may be present in or added to the bath.

Other elements may also be included for specific purposes such as nickel in the range 500 to 800 ppm to produce thinner coatings on high silicon steel or after centrifuging of small galvanized articles.

The maintenance of Al and the rare earths within their respective concentration ranges in a galvanizing bath according to this invention requires regular additions of these elements to the bath. Both Al and the rare earths react readily with oxygen and with some of the constituents of chloride-based fluxes. These elements are thus continually being lost from the bath as spent flux by-products and as constituents of the galvanized coating and bath dross. Both elements are lost to the bath at a faster rate than the zinc itself, the rare earths faster than aluminium. It follows that the weight ratio of rare earths to Al in the bath additions must be greater than the desired bath concentration ratio. The aluminium can be added separately as outlined previously and the rare earths separately or in a correctly proportioned combination.

The rare earths are usefully available as an alloy known as mischmetal. Mischmetal suitable as a source of rare earths for a galvanizing bath according to the invention has a minimum total rare earth contents of 98% by weight the balance being iron, silicon, magnesium, Al and other residual metals. The rare earths in mischmetal are predominantly cerium and/or lanthanum in combination with the other rare earths in lesser amounts.

In contrast to Al, mischmetal will not dissolve directly in a galvanizing bath at a useful rate and forms numerous high melting point intermetallic compounds with zinc when alloyed at elevated temperature. These facts restrict the range of zinc-based rare earth alloys which are useful for bath additions.

It has been found that mischmetal can be prealloyed with the make-up zinc blocks in order to maintain a galvanizing bath according to the invention, the prealloyed zinc should have a mischmetal content of 15 to 500 ppm by weight, preferably 10 to 100 ppm by weight. The prealloyed zinc may also contain amounts of other elements such as Al nickel and/or lead according to known practices. It is desirable that make-up zinc additions prealloyed with mischmetal should be made regularly to the bath, preferably each working day.

Alternatively, a zinc-based master alloy can be prepared containing at least 1% by weight of Al and preferably 3% to 15% by weight of a Al and/or at least 0 02% by weight of mischmetal and preferably 0.05% to 2.5% by weight of mischmetal. When Al and mischmetal are both present in the master alloy, the ratio of Al to mischmetal by weight should be at least 2 to 1 if this master alloy is used as the only additive of these elements to a galvanizing bath of the invention. Otherwise, the Al and rare earth elements can be maintained in a galvanizing bath of the invention by adding appropriate relative amounts of a master alloy containing Al and another containing mischmetal. In either case, the master alloy containing mischmetal should be added regularly, preferably daily, in amount approximately proportional to the rate of work throughput. The master alloy can also be used as the vehicle for adding one or more of the elements nickel, lead, tin, antimony, magnesium or copper according to known practices.

Alternatively, a mischmetal-based master alloy can be prepared containing one or more of the elements nickel, Al, zinc and copper in amounts greater than 0.5% by weight. The exact composition is chosen to enable the master alloy to dissolve in a zinc bath operating at a galvanizing temperature of approximately 450° C.

Without attempting to be exhaustive, mischmetal-based alloys of the following composition have been found more or less useful for maintaining the rare earth concentration of a galvanizing bath of this invention:

(1) Nickel alloyed in the rate 5% to 15% by weight, balance mischmetal.
(2) Compositions as in (1) and/or zinc alloyed in the range 3% to 15% by weight, balance mischmetal.
(3) Compositions as in (1) and (2) and Al alloyed in the range of 0.5% to 8% by weight.
(4) Copper alloyed in the range 10% to 20% by weight, balance mischmetal.

By way of example, a 220 tonne general jobbing galvanizing bath of composition 10 to 20 ppm by weight of Al and 0.2 to 2.5 ppm by weight of rare earths with the remainder lead-saturated zinc has been found by plant trials to give good results. This bath has been maintained within this range of composition by additions averaging per working day 9.5 kg of a zinc-based master alloy containing additionally 4.8% by weight of Al and 0.85% by weight of mischmetal and 1450 kg of make-up lead saturated zinc. Previously, this bath was maintained at a composition of 30 to 50 ppm by weight of Al, zero rare earths by additions averaging per working day 32 kg of zinc-based master alloy containing 4.1% by weight of Al with results inferior to the first trial.

In a second trial, this same bath was maintained in the same composition range as the first trial by additions averaging per working day of 10 kg of a zinc-based master alloy containing additionally 4.1% by weight of a Al and 1450 kg of make-up lead-saturated zinc prealloyed with 50 ppm of mischmetal. Again good results were achieved.

By way of a further example, a 40 tonne spin galvanizing bath of composition, 10 to 30 ppm by weight of aluminium and 0.5 to 3 ppm by weight of rare earths with the remainder lead-saturated zinc and 500 to 700 ppm by weight of nickel has been found by plant trials to give good results. This bath has been maintained within this range of composition by additions averaging per working day of 10 kg of a zinc-based master alloy containing additionally 4.1% by weight of Al and 100 g of a mischmetal-based master alloy containing additionally 8.2% by weight of nickel and 3.3% by weight of Al and 650 kg of make-up lead-saturated zinc containing additionally the make-up nickel.

Previously this same bath was maintained at a composition of 30 to 50 ppm by weight of Al, zero rare earths with the remainder lead-saturated zinc and 500 to 800 ppm by weight of nickel by additions averaging per working day of 20 kg of a zinc-based master alloy containing additionally 4.1% by weight of Al and 730 kg of make-up lead-saturated zinc containing additionally the make-up nickel with results inferior to the above trial.

In at least the preferred form of the invention it will be found that articles galvanized in a bath containing rare earths with the composition of the invention will have surface appearance superior to that produced by baths using aluminium but with no rare earths. On the common range of carbon steels containing low silicon the coatings produced according to the invention exhibit a brightness and smoothness characteristic of electroplated zinc coatings. On silicon-killed steels a bath with a composition of the invention will produce an attractive silver matt-finish coating. If the rare earths were absent from the bath, then this latter coating would typically be drab and dull-grey.

The presence of rare earths in the bath according to the invention slows down the rate of oxidation of the surface of the bath by comparison with the rate with rare earths absent. This effect extends the retention time of the zinc-mirror on the surface of the galvanizing bath after mechanical sweeping away of the ash thus allowing ample withdrawing time of the article without picking up bath surface oxidation products or ash. Galvanized articles produced under such conditions are essentially free of surface defects or at least such defects are substantially reduced.

By similar comparison, drainage from articles withdrawn from a bath of this invention is better thus producing fewer dags in jobbing work and thinner coatings on work which is subsequently centrifuged. It is believed that the increased fluidity of baths of the invention also assists in settling dross particles floating in the bath. This allows an extension of the period between drosses by a factor of about 2. Therefore a galvanizing bath which previously required drossing every 2 weeks would require drossing only every 4 weeks when maintained at a composition of the invention.

If a galvanizing bath is maintained within the preferred concentration ranges of Al and rare earths of the invention, then the disadvantages mentioned hereinbefore of baths containing a Al but no rare earths are obviated or at least minimized.

It is believed that the Al content of the surface layer of a coating is partially suppressed by such a bath composition, thus allowing simple surface treatment for white rust protection to be more effective. This extends the time to commencement of early dulling of a chromated galvanized coating and inhibits the formation of white rust under humid storage conditions.

The lower Al contents in baths according to the preferred form of the invention also substantially decreases the rate and extent of the detrimental reactions with the chloride-based flux mentioned above. This eliminates or at least substantially reduces the occurrence of defects in the coating such as black spots and Al chloride fuming above the bath and the premature breakdown of any flux blanket present on the bath surface.

I claim:

1. A zinc alloy for hot dip galvanizing comprising about 5 ppm to about 100 ppm by weight of aluminum, and a material selected from the group consisting of a rare earth metal and mixtures of rare earth metals by weight greater than 0 and not exceeded about 5 ppm, the balance being zinc and unavoidable impurities.

2. A zinc alloy as claimed in claim 1 and further comprising:

material selected from the group consisting of lead up to 1.5% by weight, nickel up to 2000 ppm by weight and mixtures thereof; and material selected from the group consisting of Sn, Cd, Cu, Sb, Mg, Si and mixtures thereof up to 0.2% by weight.

3. A zinc alloy as claimed in claim 1 wherein:

said alloy is used as a dry bath;

said aluminum content is about 10 to about 35 ppm by weight; and said rare earth content is about 0.2 to about 3 ppm by weight.

4. A zinc alloy as claimed in claim 1 wherein:

said alloy is used as a wet bath;

said aluminum content is about 5 to about 15 ppm by weight; and said rare earth content is about 0.2 to about 3 ppm by weight.

5. A method of maintaining a galvanizing bath composition containing a zinc alloy for hot dip galvanizing comprising about 5 ppm to about 100 ppm by weight aluminum, and a material selected from the group consisting of a rare earth metal and mixtures of rare earth metals by weight greater than 0 and not exceeding about 5 ppm, the balance being zinc and unavoidable impurities, the method comprising:

adding aluminum and rare earth materials to said bath so that the ratio of added rare earth materials to added aluminum is greater than the ratio of rare earth materials to aluminum in said bath.

6. A method of maintaining a galvanizing bath as claimed in claim 5 wherein:

said aluminum and said rare earth materials are added to said bath separately.

7. A method of maintaining a galvanizing bath as claimed in claim 6 wherein:

said rare earth material is prealloyed with a make-up zinc block.

8. A method of maintaining a galvanizing bath as claimed in claim 7 wherein:

said rare earth material is added as mischmetal and said prealloyed zinc block has a mischmetal content of about 5 to about 500 ppm by weight.

9. A method of maintaining a galvanizing bath as claimed in claim 8 wherein:

said mischmetal content is in a range of about 10 to about 100 ppm by weight of said make-up zinc block.

10. A method of maintaining a galvanizing bath as claimed in claim 5 wherein:

said aluminum and said rare earth materials are added to said bath simultaneously.

11. A method of maintaining a galvanizing bath as claimed in claim 10 wherein:

said simultaneous addition of said aluminum and said rare earth material comprises adding a zinc based alloy containing said aluminum and rare earth material.

12. A method of maintaining a galvanizing bath as claimed in claim 11 wherein:

said zinc based alloy contains at least about 1% by weight of aluminum.

13. A method of maintaining a galvanizing bath as claimed in claim 12 wherein said zinc based alloy contains between about 3% and about 15% by weight of aluminum.

14. A method of maintaining a galvanizing bath as claimed in claim 13 wherein:

said rare earth material is added to said zinc based alloy in the form of mischmetal.

15. A method of maintaining a galvanizing bath as claimed in claim 14 wherein:

said zinc based alloy contains at least about 0.02% by weight of mischmetal.

16. A method of maintaining a galvanizing bath as claimed in claim 15, wherein:

said added materials contain between about 0.05% to 2.5% by weight of mischmetal.

17. A zinc alloy as claimed in claim 2 wherein:

said alloy is used as a dry bath;

said aluminum content is about 10 to about 35 ppm by weight; and said rare earth content is about 0.2 to about 3 ppm by weight.

18. A zinc alloy as claimed in claim 2 wherein:

said alloy is used as a wet bath;

said aluminum content is about 5 to about 15 ppm by weight; and said rare earth content is about 0.2 to about 3 ppm by weight.

19. A method of maintaining a galvanizing bath as claimed in claim 19 wherein:

said rare earth material is added to said zinc based alloy in the form of mischmetal.

20. A method of maintaining a galvanizing bath as claimed in claim 11 wherein:

said rare earth material is added to said zinc based alloy in the form of mischmetal.

* * * * *